United States Patent [19]

Berwin

[11] Patent Number: 5,047,756

[45] Date of Patent: Sep. 10, 1991

[54] VIDEO COMPENSATION APPARATUS FOR STROKE MODE CRT DISPLAYS

[75] Inventor: Ted W. Berwin, Playa del Rey, Calif.

[73] Assignee: Hughes Aircraft Company, Los Angeles, Calif.

[21] Appl. No.: 369,984

[22] Filed: Jun. 22, 1989

[51] Int. Cl.[5] ..... G09G 1/04; G09G 1/10

[52] U.S. Cl. ..... 340/723; 340/733; 340/739; 340/742

[58] Field of Search ..... 315/383, 386, 367; 324/121 R, 88; 340/735-742, 732

[56] References Cited

U.S. PATENT DOCUMENTS

| | | | |
|---|---|---|---|
| 3,403,288 | 9/1968 | Bradley | 340/742 |
| 3,537,098 | 9/1966 | Nielsen | 340/739 |
| 3,976,991 | 8/1976 | Hickin et al. | 340/742 |
| 4,001,806 | 1/1977 | Sweeting | 340/739 |
| 4,215,294 | 7/1980 | Taggart | 315/383 |
| 4,251,814 | 2/1981 | Dagostino | 340/739 |

*Primary Examiner*—Jeffery A. Brier
*Assistant Examiner*—Steve Saras
*Attorney, Agent, or Firm*—Leonard A. Alkov; Wanda Denson-Low

[57] ABSTRACT

A stroke-mode CRT display having a Z channel (video) compensation circuit is disclosed. The function of the compensation circuit to correct for the lag of the X and Y channels in relation to the Z channel. The compensation circuit is designed so that transfer function characteristic is identical to that of the respective deflection amplifier and coil circuitry for the X and Y channels. With the compensation circuitry, the X, Y and Z channel signals are in proper relation to one another, and high quality symbology is achieved.

8 Claims, 2 Drawing Sheets

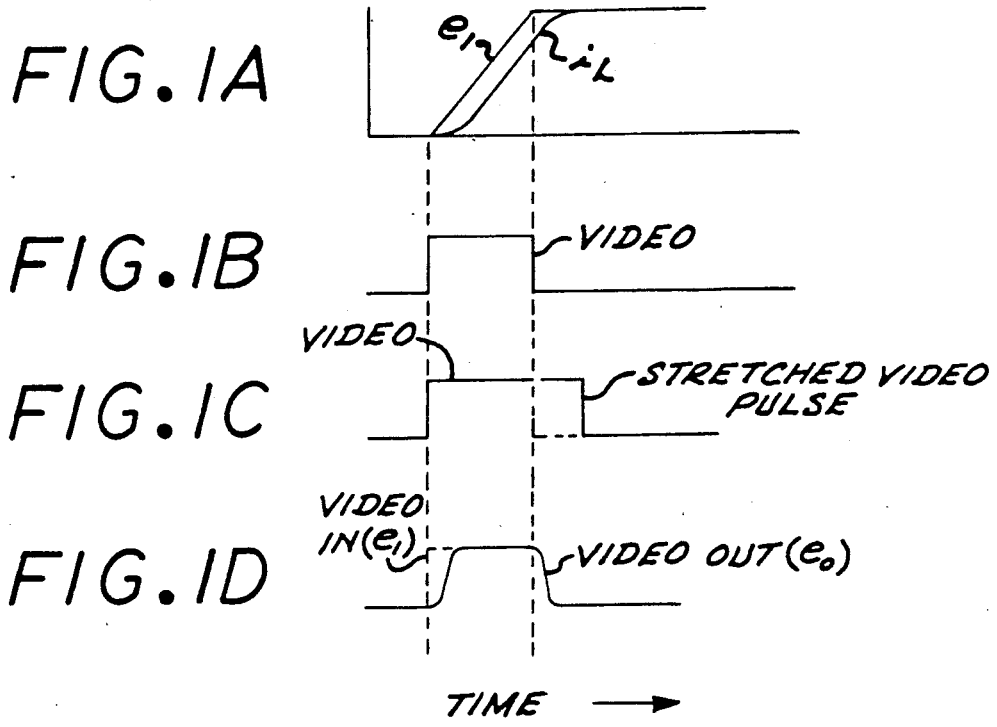
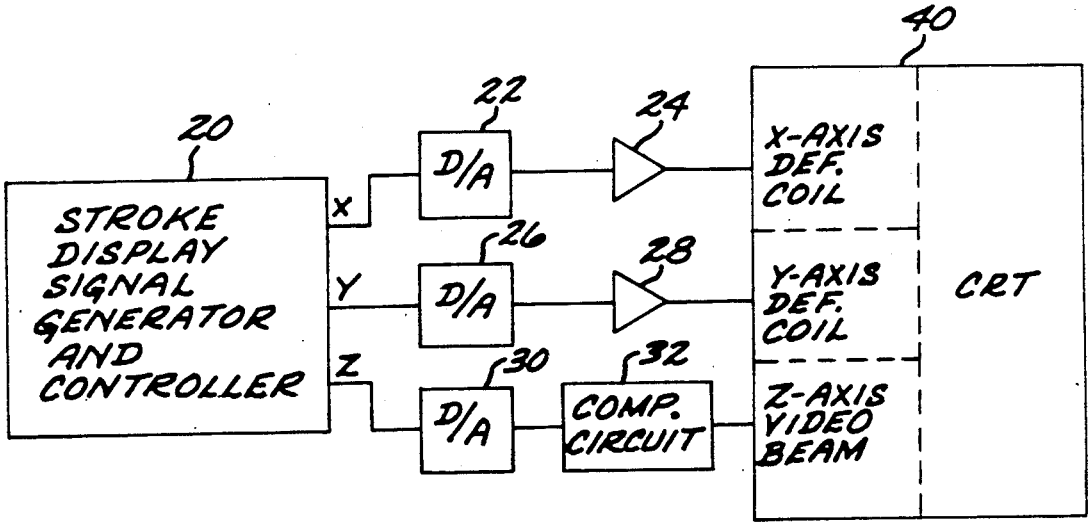
FIG. 2

VIDEO COMPENSATION APPARATUS FOR STROKE MODE CRT DISPLAYS

BACKGROUND OF THE INVENTION

The present invention relates to stroke mode or vector driven CRT displays, and more particularly to an apparatus for correcting for the inherent lag between the X and Y CRT channel signals and the video or Z axis channel signal.

Stroke mode CRT displays, also known as vector driven displays, are a well-known type of CRT display. In contrast to raster displays, wherein the beam is driven through a predetermined set of lines according to a particular sweep rate and refresh rate to provide substantially complete beam coverage for a given frame, and the beam turned on at particular pixels to create a particular image, stroke mode CRT displays do not employ a predetermined, repetitive beam line format, but rather the X and Y beam deflection amplifiers are independently driven or controlled so as to draw a particular line or symbol.

Symbol video data written in stroke mode on a CRT has to be corrected at the beginning and end of each stroke, because magnetic deflection amplifier and deflection coil circuitry are necessarily slow at startup and stopping, due to the delayed response characteristics of the beam deflection circuitry. At startup, the beam may take typically 300 nanoseconds to start moving, and a similar time interval to stop moving at the end of a stroke. The X and Y coil drive current waveforms thus typically lag the respective amplifier input by 300 nanoseconds. This is illustrated in FIG. 1A, which depicts the control signal e, and the resulting deflection amplifier drive current $i_L$ passing through the deflection coil.

One solution to this problem has been to stretch the video or Z axis beam signal to correct for the stop delay. FIG. 1B illustrates the video signal in time relation to the deflection amplifier signals of FIG. 1A. As shown in FIG. 1B, the video signal is turned on before the beam begins to move (i.e., deflect), and is turned off before it reaches its end point. The conventional compensation has been to stretch the video until it reaches its endpoint (FIG. 1C), e.g., by use of a one-shot device. However, with this correction, the start and the end of a stroke are overbright because the beam is on before the beam gets up to speed, and the beam remains on for a short time after the beam stops moving, causing bright spots.

SUMMARY OF THE INVENTION

It would therefore represent an advance in the art to provide a video signal correction circuit for a stroke mode CRT display which results in proper temporal relation between the beam deflection signals and the video control signal.

In accordance with the invention, a video correction apparatus is employed in a stroke mode CRT display for correcting for the delayed response of the X and Y deflection circuitry. The Z axis or video data signals are passed through a circuit having a transfer characteristic identical to that of the X and Y CRT deflection circuitry. Thus, for a given CRT display, the transfer characteristic of the X and Y deflection circuitry is determined. A circuit is provided which has a transfer function characteristic identical to the characteristic of the deflection circuitry. The video signal is passed through the correction circuitry so that the Z axis control signal fed to the CRT has been compensated for the delayed response characteristics of the beam deflection circuitry. With the invention, the X, Y and Z channel signals remain in proper temporal relation to one another, thereby providing the capability for high quality stroke mode symbology.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1A depicts the typical delay between a drive signal input to a CRT deflection amplifier and coil, and the resulting current $i_L$ through the coil.

FIG. 1B depicts the envelope of a typical video (Z channel) beam control signal to accompany the beam deflection signals of FIG. 1A.

FIG. 1C depicts the "stretching" of the video pulse as performed by conventional compensation techniques.

FIG. 1D depicts the effect or the video signal of the beam compensation circuit in accordance with the present invention.

FIG. 2 is a schematic block diagram of a stroke mode CRT display employing the invention.

DESCRIPTION OF THE PREFERRED EMBODIMENT

FIG. 2 is a schematic block diagram of a stroke mode CRT display employing the invention. A stroke mode CRT display typically comprises a stroke display signal generator and controller 20. The functions of this controller include generating the X, Y and Z (video) channel signals for controlling the CRT beam position, deflection and brightness.

In the implementation of FIG. 2, the signals generated by the controller 20 are in digital form, and are converted to analog form by respective digital-to-analog converters (DACs) 22, 26 and 30. Thus, the controller 20 generates the X and Y beam deflection control signals and the Z axis or video signals controlling the brightness of the electron beam of the CRT. The DACs 22, 26 and 30 convert the digital control signals from the controller 20 into analog signals and in turn the analog X and Y signals drive the X and Y deflection amplifiers 24 and 28. The output of the analog deflection amplifiers in turn drives the deflection coils of the CRT 40 to deflect the beam. The amplifiers 24 and 28 and the deflection coils are conventional in their construction and operation.

Due to the inductance of the deflection coils of the CRT and the impedance of the deflection amplifiers, the current through the respective deflection coils lags the Z channel signals as described above. Typically, the lag time is about 300 nanoseconds. In accordance with the invention, a Z channel compensating circuit 32 is provided. The circuit 32 is designed so that its transfer function characteristic is identical to the transfer function of the deflection amplifier and deflecting coil circuitry of the respective X and Y channels. It is assumed that the X and Y channel circuitry have the same transfer function. The transfer characteristic of the X and Y channel circuitry may be determined by calculation, computer modeling or actual measurement using a network analyzer equipment.

Figure 3:
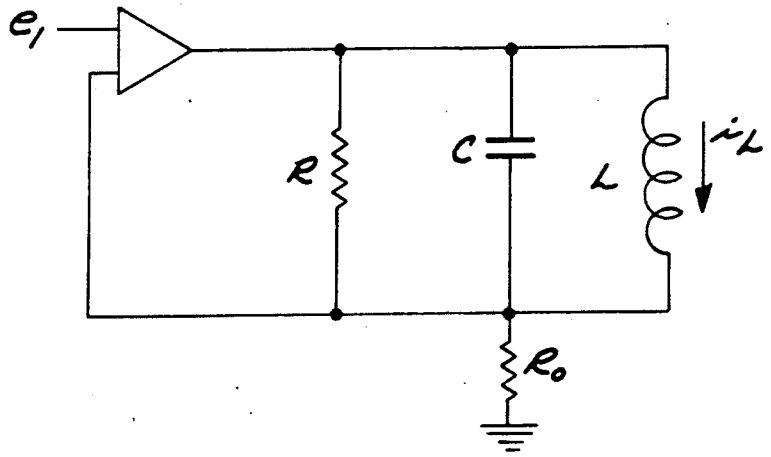
FIG. 3 is a simplified schematic diagram of a typical deflection amplifier and deflection coil circuit.

FIG. 3 is a simplified schematic diagram of an exemplary deflection amplifier and coil circuit. The circuit comprises an operational amplifier, a resistor (R), a capacitor (C) and the deflection coil of inductance L. When the drive signal is $e_1$, and the current through the coil is $i_L$, the transfer function of the circuit is given by second order eq. 1:

$$i_L/e_1 = 1/R_0(LCs^2 + (L/R)s + 1) \quad (1)$$

Figure 4:
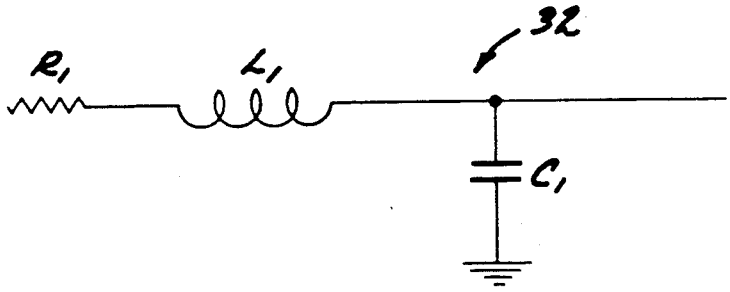
FIG. 4 is a schematic diagram of a typical video correction circuit employed in the display of FIG. 1.

The circuitry of one form of the compensation circuit 32 is shown in schematic form in FIG. 4, and comprises a resistor(R)-inductor(L)-capacitor(C) circuit. The transfer function of the compensation circuit 32 is given by second order eq. 2, where $e_1$ is the exciting signal and $e_o$ is the response signal:

$$e_0/e_1 = 1/((L_1C_1)s^2 + (R_1C_1)s + 1) \quad (2)$$

The circuit values $R_1$, $L_1$, $C_1$ for the compensation circuit 32 are selected so that the coefficient of the $s^2$ term ($L_1C_1$) is made the same value of the coefficient of the $s^2$ term of the transfer function of the deflection amplifier (LC). Similarly, the circuit value is selected so that the coefficient of the s term ($R_1C_1$) is made the same value as the coefficient of the s term of the transfer function of the deflection amplifier (L/R).

Figure 5:
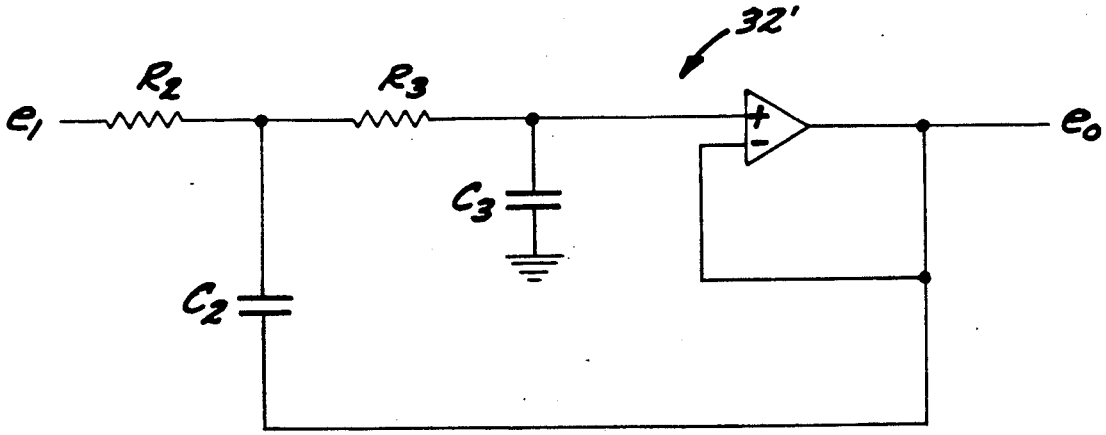
FIG. 5 is a schematic diagram of an alternate form of the video correction circuit employed in the display of FIG. 2.

An alternate form of the compensation circuit is shown in the schematic diagram of FIG. 5. Here the compensation circuit 32' comprises an R-C-operational amplifier circuit. The transfer function of circuit 32' is given by eq. 3:

$$e_0/e_1 = 1/((R_2C_2 + R_3C_3)s^2 + ((R_2 + R_3)\ C_3)s + 1) \quad (3)$$

As in the embodiment of FIG. 4, the circuit values ($R_2$, $R_3$, $C_2$, $C_3$) are selected so that the corresponding coefficients of the $s^2$ and $s^2$ terms in the transfer functions of the deflection amplifier and the compensation circuit are the same. In many applications, the circuit of FIG. 5 will be implemented more readily than that of FIG. 4 because it does not require an inductor element.

As an example, consider the situation where the X and Y channel deflection circuitry (including the deflection amplifier and the deflection coil) are each determined to have a transfer function equal to the that of eq. 1. For such an example, the corresponding compensation circuit element values for the compensation circuit 32' of FIG. 5 are selected so that $LC = (R_2C_2 + R_3C_3)$ and $L/R = (Rhd\ 2 + R_3)C_3)$. Then the respective deflection amplifier and coil circuit and the compensation circuit have the same response.

Because the X, Y and Z channel signals now pass through circuitry having identical transfer function characteristics, the X and Y channel signals no longer lag the Z channel signal, so that the stroke mode symbology drawn on the CRT is of high quality. The effect of the compensation circuit on the Z channel signal $e_1$ is illustrated qualitatively in FIG. 1D, which shows the Z axis (or beam video) signal (dotted line) as it is input to the compensation circuit and as it is output from the compensation circuit (solid line).

It is understood that the above-described embodiments are merely illustrative of the possible specific embodiments which may represent principles of the present invention. Other arrangements may readily be devised in accordance with these principles by those skilled in the art without departing from the scope of the invention.

What is claimed is:

1. A stroke mode CRT display including a controller for generating X and Y channel signals for controlling the X and Y deflection amplifiers of the CRT, and a Z channel control signal for controlling the CRT beam brightness, wherein the respective X amplifier and deflection coil circuitry and the Y amplifier and deflection coil circuitry are characterized by a known transfer function characteristic, the improvement comprising a Z channel compensation circuit characterized by the same transfer function characteristic as that of the respective X and Y amplifier circuitry, whereby the X, Y and Z signals are properly temporally related to each other wherein said compensation circuit comprises a resistor ($R_1$)-capacitor ($C_1$)-inductor ($L_1$) circuit, and wherein the circuit element values R, C and L are selected so that the transfer function of the compensation circuit substantially matches that of said deflection amplifier and coil.

2. The improvement of claim 1 wherein said transfer function characteristic of said deflection amplifier and coil circuitry is represented by $1/(R_0(LCs^2 + 2)$, where $R_0$ and R represent the resistance values of respective resistors comprising the amplifier circuit, C represents the capacitance value and L the inductance value of respective capacitor and inductor elements comprising the amplifier circuit, and wherein the transfer function of the compensation circuit is characterized by $(1/((L_1C_1)s^2 + (R_1D_1)s + 1)$, and the compensation circuit values are selected such that $(L_1C_1) = LC$ and $R_1C_1 = L/R$.

3. The improvement of claim 1 wherein said compensation circuit comprises an operational amplifier, first and second resistors $R_2$ and $R_3$ and first and second capacitors $C_2$ and $C_3$ and an operational amplifier, and wherein the respective resistor and capacitor circuit elements are selected so that the transfer function of the compensation circuit substantially matches that of said deflection amplifier and coil.

4. The improvement of claim 3 wherein said transfer function characteristic of said deflection amplifier and coil circuitry is represented by $1/(R_0(LCs^2 + Ls/R + 1)$, and wherein the transfer function characteristic of the compensation circuit is represented by $(1/((R_2C_2 + R_3C_3) + ((R_2 + R_3)C_3)s + 1)$, and wherein the circuit element values of the compensation circuit are selected so that $(R_2C_2 + R_3C_3) = LC$ and $((R_2 + R_3)C_3) = L/R$.

5. A stroke mode CRT display apparatus for operating in at least a stroke mode, comprising:

X and Y beam deflection amplifiers;

X and Y beam deflection coils;

CRT beam generation apparatus for generating a beam in response to Z channel control signal;

a display controller for generating respective X, Y and Z channel control signals to draw a desired beam stroke, said X and Y channel control signals for controlling the respective X and Y beam deflection amplifiers, and said Z channel control signal for controlling the intensity of said CRT beam;

Z channel compensating circuit coupling said controller to said beam generation apparatus, said compensating circuit characterized by a transfer function which is substantially identical to that of the respective X and Y beam deflection amplifiers and coils wherein said compensating circuit comprises a resistor ($R_1$)-capacitor ($C_1$)-inductor($L_1$)circuit, and wherein the circuit element values R, C and L are selected so that the transfer function of the compensation circuit substantially matches that of said deflection amplifier and coil.

6. The improvement of claim 4 wherein said transfer function characteristic of said deflection amplifier and coil circuitry is represented by $1/(R_0(LCs^2+(L/R)s+1)$, where $R_0$ and R represent the ;resistance values of respective resistors comprising the amplifier circuit, C represents the capacitance value and L the inductance value of respective capacitor and inductor elements comprising the amplifier circuit, and wherein the transfer function of the compensation circuit is characterized by $(1/((L_1sC_1)s^2+(R_1C_1)s+1)$, and the compensation circuit values are selected such that $(L_1C_1)=LC$ and $R_1C_1=L/R$.

7. The improvement of claim 5 wherein said compensation circuit comprises an operational amplifier, first and second resistors $R_2$ and $R_3$ and first and second capacitors $C_2$ and $C_3$, and wherein the respective resistor and capacitor circuit elements are selected so that the transfer function of the compensation circuit substantially matches that of said deflection amplifier and coil.

8. The improvement of claim 7 wherein said transfer function characteristic of said deflection amplifier and coil circuitry is represented by $1/(R_0(LCs^2+Ls/R+1)$, and wherein the transfer function characteristic of the compensation circuit is represented by $(1/((R_2C_2+R_3C_3)+((R_2+R_3)C_3)s+1)$, and wherein the circuit element values of the compensation circuit are selected so that $(R_2C_2+R_3C_3)=LC$ and $((R_2+R_3)C_3)=L/R$.

* * * * *